US006564431B2

(12) United States Patent
Cherif et al.

(10) Patent No.: US 6,564,431 B2
(45) Date of Patent: May 20, 2003

(54) SILVER DEFLECTING DEVICE POSITIONED BETWEEN TWO DRAFTING ROLL PAIRS OF A SILVER DRAFTING UNIT

(75) Inventors: Chokri Cherif, Ingolstadt (DE); Burkhard Wulfhorst, Stolberg (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/994,906

(22) Filed: Nov. 28, 2001

(65) Prior Publication Data

US 2002/0066165 A1 Jun. 6, 2002

(30) Foreign Application Priority Data

Nov. 28, 2000 (DE) ..... 100 59 117

(51) Int. Cl.[7] ..... D01H 5/72
(52) U.S. Cl. ..... 19/288; 19/258
(58) Field of Search ..... 19/288, 248, 236, 19/244, 249, 251, 290, 259, 258, 253, 250

(56) References Cited

U.S. PATENT DOCUMENTS 4,430,774 A * 2/1984 Bothner ..... 19/105
5,016,323 A * 5/1991 Wehrli et al. ..... 19/258
5,048,157 A * 9/1991 Wehrli ..... 19/249
5,608,948 A * 3/1997 Hauner et al. ..... 19/258
5,689,858 A * 11/1997 Hauner et al. ..... 19/236
6,151,760 A * 11/2000 Weber ..... 19/150

FOREIGN PATENT DOCUMENTS

DE 30 16 409 11/1981
DE 42 42 722 6/1994

OTHER PUBLICATIONS

Cherif et al, "Neue Erkenntnisse über Verzugsvorgänge an Hochleistungs–Baumwollstrecken", Melliand Textilberichte Jun. 1998, pp. 403–407.

* cited by examiner

*Primary Examiner*—Danny Worrell
(74) *Attorney, Agent, or Firm*—Venable; Robert Kinberg; Stuart I. Smith

(57) ABSTRACT

A fiber processing machine includes a sliver drafting unit which has first and second adjoining roll assemblies each defining a nip through which a sliver runs in a sliver advancing direction. The second roll assembly is spaced downstream of the first roll assembly. The nips of the first and second roll assemblies together define a principal drafting field and the drafting direction thereof. At least two pressure bars are disposed in the principal drafting field for contacting and deflecting the sliver from the drafting direction as the sliver advances from the first roll assembly to the second roll assembly.

14 Claims, 2 Drawing Sheets

Fig. 1
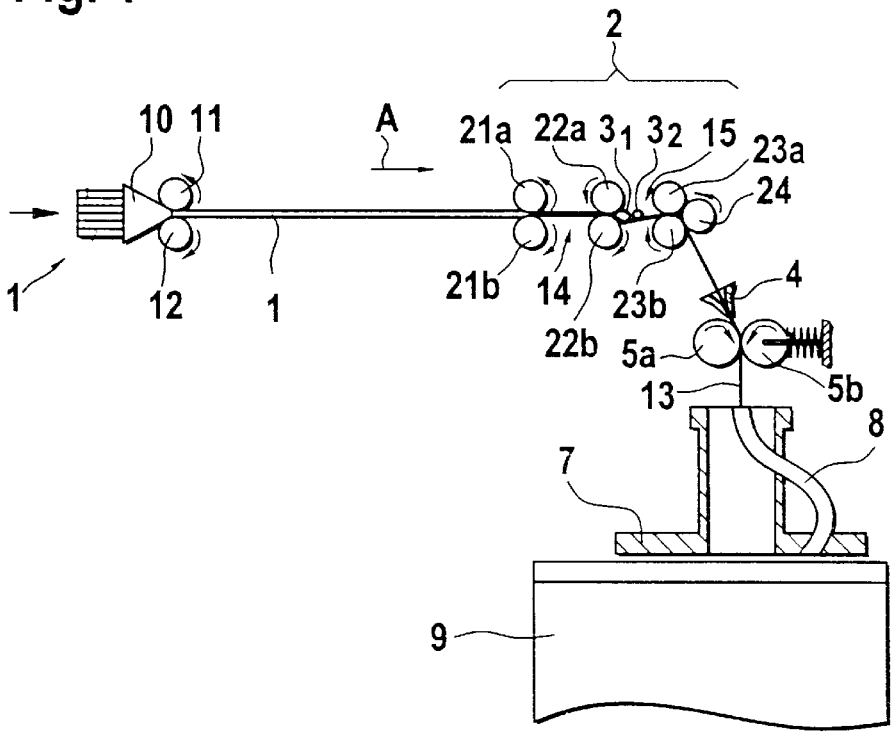
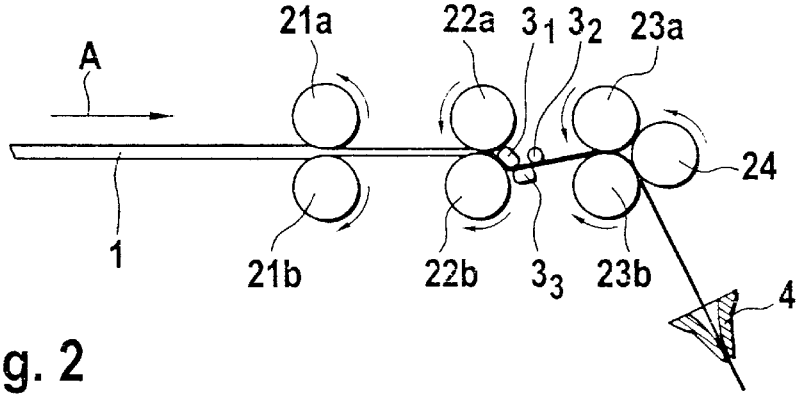
Fig. 2

Fig. 3
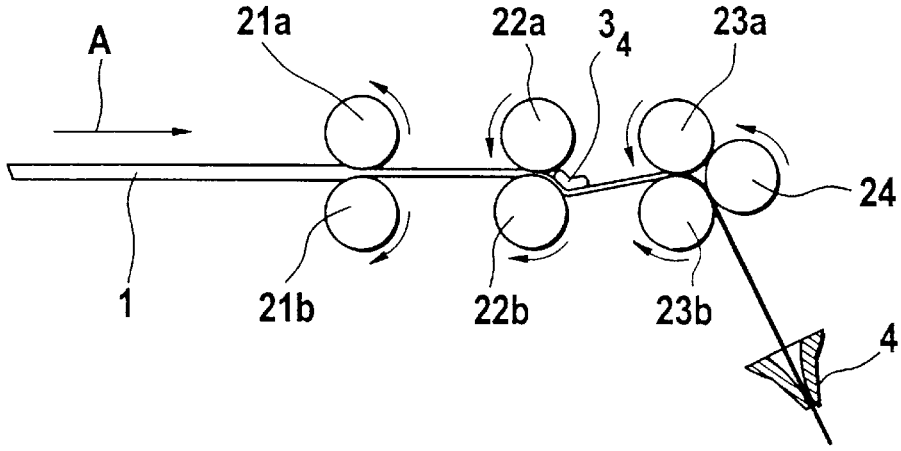
Fig. 3a
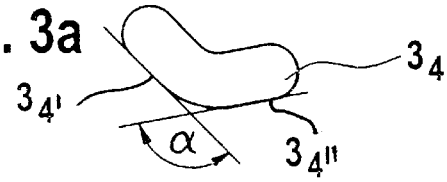
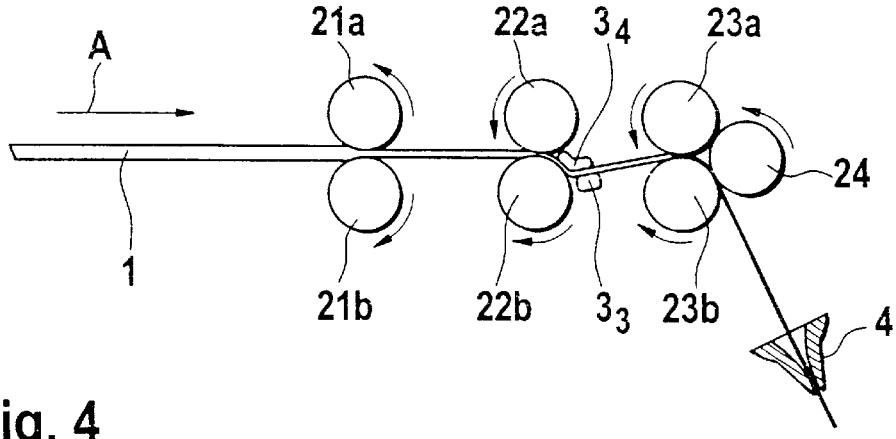
Fig. 4

SILVER DEFLECTING DEVICE POSITIONED BETWEEN TWO DRAFTING ROLL PAIRS OF A SILVER DRAFTING UNIT

CROSS REFERENCE TO RELATED APPLICATION

This application claims the priority of German Application No. 100 59 117.5 filed Nov. 28, 2000, which is incorporated herein by reference.

BACKGROUND OF THE INVENTION

The invention relates to a deflecting and guiding device for slivers of cotton, chemical fibers or the like and is positioned between first and second spaced roll pairs which clamp the running sliver and which draft the same by virtue of a greater rotating speed of the second roll pair situated downstream of the first roll pair. The device includes a pressure bar positioned between the two roll pairs. The pressure bar deflects the sliver as it runs from the first roll pair to the second roll pair. The two roll pairs together define the principal drafting field.

The invention particularly concerns an optimized configuration of a pressure bar arrangement for improving the guidance of textile fibers in drafting units which are designed for drafting a plurality of simultaneously running slivers and which have a decisive effect on the uniformity of the drafted slivers.

Slivers are drafted by passing them through roll pairs (usually three in number) whose circumferential speed increases in the advancing direction of the sliver. The purpose of doubling the sliver is to even the fineness fluctuations along small and large lengths. In the drafting process those fibers are critical whose length is shorter than the clamping distance between two consecutive roll pairs. Such short fibers are, for a brief period, not clamped either by the leading roll pair nor by the upstream-adjoining the trailing roll pair and may thus move in an uncontrolled manner. These "floating" fibers are responsible for the drafting waves which negatively affect the uniformity of the slivers. The number of floating fibers is dependent from the fiber length distribution of the material and from the set distance between the clamping nips of two adjoining roll pairs. The greater these distances, the higher the proportion of floating and uncontrolled fibers. For this reason, current drafting units are provided with a stationary pressure bar disposed in the principal drafting field. By means of such an arrangement the floating fibers are better guided and thus a significantly improved sliver uniformity is achieved.

In a device disclosed in German Offenlegungsschrift (application published without examination) 42 42 722, a reduction of deposits on the pressure bar is achieved by an optimization of the pressure bar geometry. The pressure bar which is stationarily supported along the width of the drafting field, has a rectangular cross section whose narrow end faces are semi-circularly rounded.

German Offenlegungsschrift 30 16 409 describes a fiber guiding device which consists of a pressure bar having a bent shoe oriented towards the outlet roll pair. An opening of a suction channel is arranged at the end of the shoe.

"Melliand Textilberichte" ("Melliand Textile Reports") 79 (1998), describes on pages 403, 404, 406 and 407 that the behavior of the fiber motion in the drafting fields is significantly dependent from the delivery speed. At low speeds, as a rule, a uniform fiber motion occurs. At higher speeds, in the middle of the drafting field, a sudden acceleration takes place which is coupled with a significant deterioration of the sliver uniformity. It has been observed that the fiber speed is less constant both along the width of the sliver and over time. In addition, in a part of the slivers a more pronounced alternation of acceleration and deceleration occurs, that is, the fiber acceleration is not continuous. These effects have their cause in an increase in the fluctuation of sliding properties of the material and the fluctuation of the sliver thickness and thus in the uncontrolled guidance of the slivers in the principal drafting field. These fluctuations of the fiber motions are the reason why the slivers become non-uniform.

SUMMARY OF THE INVENTION

It is an object of the invention to provide a device of the above-outlined type from which the discussed disadvantages are eliminated. It is a particular object of the invention to optimize the design of known pressure bars for ensuring a better guidance of the slivers, particularly at very high production speeds (greater than 600 m/min).

These objects and others to become apparent as the specification progresses, are accomplished by the invention, according to which, briefly stated, the fiber processing machine includes a sliver drafting unit which has first and second adjoining roll assemblies each defining a nip through which a sliver runs in a sliver advancing direction. The second roll assembly is spaced downstream of the first roll assembly. The nips of the first and second roll assemblies together define a principal drafting field and the drafting direction thereof. A sliver guiding device composed of at least two pressure bars disposed in the principal drafting field for contacting and deflecting the sliver as the sliver advances from the first roll assembly to the second roll assembly.

The pressure bar arrangement according to the invention results in a significantly better guidance of the slivers in the principal drafting field. Further, a reduction of fiber fly of unguided or floating fibers which become loose from the sliver is achieved. In this manner, a significantly reduced number of good fibers will be wasted.

Expediently, the pressure bar according to the invention has, as compared to conventional arrangements, a new geometry which deflects the fibers in the principal drafting field and contacts the fibers over a surface area. The size of the surface area may be selected as a function of the fiber material (material type, fiber length distribution, proportion of floating fibers, etc.). This variant is particularly adapted for slivers having a high proportion of floating fibers and in case the nip distance between adjoining drafting roll pairs is large. The sliver-contacting surface area may be oriented horizontally or may have an inclination to the drafting direction. Expediently, two fiber guiding components having flat sliver-contacting surface areas are used between which the fiber material passes.

BRIEF DESCRIPTION OF THE DRAWINGS

FIG. 1 is a schematic side elevational view of a drafting unit of a draw frame incorporating a preferred embodiment of the invention.

FIG. 2 is a view similar to FIG. 1, incorporating another preferred embodiment of the invention.

FIG. 3 is a view similar to FIG. 2, incorporating yet another preferred embodiment of the invention.

FIG. 3*a* is an enlarged side elevational view of a component illustrated in FIG. 3.

FIG. 4 is a view similar to FIG. 2, illustrating yet another preferred embodiment of the invention.

DESCRIPTION OF THE PREFERRED EMBODIMENTS

FIG. 1 illustrates the basic operational mode of a draw frame which may be, for example, an HS model, manufactured by Trützschler GmbH & Co. KG, Mönchengladbach, Germany. A plurality of slivers 1 are inputted side-by-side into the drafting unit 2 which, as a rule, has three roll assemblies between which the drafting proper takes place. The roll assemblies are constituted by an input roll pair 21*a*, 21*b*, a middle roll pair 22*a*, 22*b* and an output roll assembly composed of rolls 23*a*, 23*b* and 24. The slivers 1 are drafted as a function of the speed ratios of the different circumferential speeds of the roll assemblies. The drafting unit 2 essentially is composed of a preliminary drafting field 14 (defined between the roll assemblies 21*a*,21*b* and 22*a*,22*b*) and a principal drafting field 15 (defined between the roll assemblies 22*a*,22*b* and 23*a*,23*b*,24) . The nips of adjoining roll assemblies define the drafting direction of the drafting fields.

Prior to introducing the slivers into the drafting unit 2, the slivers pass through a sliver guide 10 and are advanced towards the drafting unit 2 by calender rolls 11, 12. The drafted slivers are combined into a single drafted sliver 13 by means of a sliver trumpet 4. The sliver is pulled by calender rolls 5*a*, 5*b* and eventually deposited into a coiler can 9 by a rotary coiler head 7 preceded by a sliver channel 8.

In the principal drafting field 15 two pressure bars $\mathbf{3}_1$ and $\mathbf{3}_2$ are positioned which contact and deflect the slivers 1. In this manner a better guidance of the shorter (floating) fibers is achieved which leads to an evening of the drafted slivers. The pressure bars $\mathbf{3}_1$ and $\mathbf{3}_2$ are stationary during operation and extend over the entire width of the principal drafting field 15. The pressure bars $\mathbf{3}_1$ and $\mathbf{3}_2$ are disposed in series as viewed in the advancing direction (working direction) A.

Turning to FIG. 2, two pressure bars $\mathbf{3}_1$ and $\mathbf{3}_2$ are positioned above the slivers 1 and a further pressure bar $\mathbf{3}_3$ is positioned thereunder. The slivers are deflected downwardly by the pressure bar $\mathbf{3}_1$ and run first between the pressure bars $\mathbf{3}_1$ and $\mathbf{3}_3$, and then between the pressure bars $\mathbf{3}_2$ and $\mathbf{3}_3$. The pressure bars $\mathbf{3}_1$ and $\mathbf{3}_3$ have a cross-sectionally elongated shape while the pressure bar $\mathbf{3}_2$ has a substantially circular cross section.

In the embodiment illustrated in FIGS. 3 and 3*a*, two pressure bars $\mathbf{3}_4$ are provided which are integrated (for example, soldered or welded to one another) into a one-piece, unitary component to form a fiber guiding member. The sliver-contacting surface areas $\mathbf{3}_{4'}$and $\mathbf{3}_{4''}$of the pressure bars $\mathbf{3}_4$ are oriented at an oblique angle $\alpha$ to one another and to the advancing direction A of the slivers 1. The pressure bars $\mathbf{3}_4$ are situated above the slivers 1.

In the embodiment shown in FIG. 4, the pressure bars $\mathbf{3}_4$ are situated above the slivers 1 whereas the pressure bar $\mathbf{3}_3$ is situated therebelow.

The pressure bars $\mathbf{3}_1$, $\mathbf{3}_2$, $\mathbf{3}_3$ and $\mathbf{3}_4$ have rounded portions and a smooth upper surface.

The invention was described for a drafting unit of a draw frame. The invention, however, may find application in other drafting units forming part, for example, of ring spinning machines, combing machines and the like.

It will be understood that the above description of the present invention is susceptible to various modifications, changes and adaptations, and the same are intended to be comprehended within the meaning and range of equivalents of the appended claims.

What is claimed is:

1. A fiber processing machine comprising a sliver drafting unit; said sliver drafting unit comprising:

first and second adjoining roll assemblies each having a nip through which a sliver runs in a sliver advancing direction; said second roll assembly being spaced downstream of said first roll assembly as viewed in the sliver advancing direction; said nips of said first and second roll assemblies together define a principal drafting field and a drafting direction thereof; and at least two pressure bars disposed in said principal drafting field for contacting the sliver as the sliver advances from said first roll assembly to said second roll assembly; at least one of said pressure bars being arranged for deflecting the sliver from said drafting direction, wherein two of the at least two pressure bars are located on opposite sides of a path of the sliver.

2. The fiber processing machine as defined in claim 1, wherein said pressure bars are stationary.

3. A fiber processing machine comprising a sliver drafting unit; said sliver drafting unit including (a) first and second adjoining roll assemblies each having a nip through which a sliver runs in a sliver advancing direction; said second roll assembly being spaced downstream of said first roll assembly as viewed in the sliver advancing direction; said nips of said first and second roll assemblies together define a principal drafting field and a drafting direction thereof; and (b) at least two pressure bars disposed in said principal drafting field for contacting the sliver as the sliver advances from said first roll assembly to said second roll assembly; at least one of said pressure bars being arranged for deflecting the sliver from said drafting direction, wherein said pressure bars are arranged at substantially identical height levels.

4. The fiber processing machine as defined in claim 1, wherein said pressure bars are arranged vertically above one another.

5. The fiber processing machine as defined in claim 1, wherein said pressure bars are arranged above one another with a horizontal offset.

6. The fiber processing machine as defined in claim 1, wherein at least one of said pressure bars has a planar sliver-contacting surface area.

7. The fiber processing machine as defined in claim 1, wherein at least two of said pressure bars have a planar sliver-contacting surface area.

8. The fiber processing machine as defined in claim 1, wherein at least two of said pressure bars have a planar sliver-contacting surface area; the surface areas are oriented at an oblique inclination to one another.

9. The fiber processing machine as defined in claim 1, wherein at least one of said pressure bars has a planar sliver-contacting surface area oriented parallel to said drafting direction.

10. The fiber processing machine as defined in claim 1, wherein at least one of said pressure bars has a planar sliver-contacting surface area oriented obliquely to said drafting direction.

11. The fiber processing machine as defined in claim 1, wherein at least two of said pressure bars have a planar sliver-contacting surface area oriented at an oblique inclination to one another; further wherein said at least two pressure bars adjoin one another and are inter-connected to form a one-piece construction.

12. The fiber processing machine as defined in claim 1, wherein said fiber processing machine is a draw frame.

13. A fiber processing machine comprising a sliver drafting unit; said sliver drafting unit comprising:

first and second adjoining roll assemblies each having a nip through which a sliver runs in a sliver advancing direction; said second roll assembly being spaced downstream of said first roll assembly as viewed in the sliver advancing direction; said nips of said first and second roll assemblies together define a principal drafting field;

a pressure bar arrangement disposed in said principal drafting field for contacting and deflecting the sliver from said drafting direction as the sliver advances from said first roll assembly to said second roll assembly; said pressure bar arrangement having two planar, sliver-contacting surface areas being oriented at an oblique inclination to one another and adjoining one another in the sliver advancing direction; and a separate pressure bar, wherein said pressure bar arrangement and said separate pressure bar are located on opposite sides of a path of the sliver.

14. The fiber processing machine as defined in claim 1, wherein said pressure bars are arranged at substantially identical height levels.

* * * * *